US006720371B2

(12) United States Patent
Furuta et al.

(10) Patent No.: US 6,720,371 B2
(45) Date of Patent: Apr. 13, 2004

(54) WATER REPELLENT AND OIL RESISTANT COMPOSITION

(75) Inventors: Shoji Furuta, Kanagawa (JP); Ryuji Seki, Kanagawa (JP); Hiroshi Funaki, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 60 days.

(21) Appl. No.: 10/164,577

(22) Filed: Jun. 10, 2002

(65) Prior Publication Data

US 2003/0040568 A1 Feb. 27, 2003

Related U.S. Application Data

(63) Continuation of application No. PCT/JP01/08901, filed on Oct. 10, 2001.

(30) Foreign Application Priority Data

Oct. 10, 2000 (JP) ..... 2000-309748

(51) Int. Cl.[7] ..... C08K 5/06

(52) U.S. Cl. ..... 524/47; 524/52; 524/366; 524/376; 524/186; 524/503; 524/520

(58) Field of Search ..... 524/47, 52, 186, 524/366, 376, 503, 520

(56) References Cited

U.S. PATENT DOCUMENTS 6,306,944 B1 10/2001 Seki ..... 524/366

FOREIGN PATENT DOCUMENTS

| | | |
|---|---|---|
| EP | 713939 | 5/1996 |
| EP | 787855 | 8/1997 |
| EP | 1004701 | 5/2000 |
| JP | 10-168435 | 6/1998 |

*Primary Examiner*—Peter D. Mulcahy
(74) *Attorney, Agent, or Firm*—Oblon, Spivak, McClelland, Maier & Neustadt, P.C.

(57) ABSTRACT

A water repellent and oil resistant composition capable of imparting excellent water repellency and oil resistance to paper even under a condition of drying at a low temperature for a short time, is provided.

The composition comprising a fluorocopolymer (A) obtained by polymerizing a polyfluoroalkyl group-containing (meth)acrylate, vinylidene chloride and a compound of the formula [$CH_2{=}C(R)COO{-}CH_2{-}CH(OH)CH_2N^+(CH_3)^3{\cdot}X^-$ (R: a hydrogen atom or a methyl group, and $X^-$: a counter ion)] or the like by means of a lipophilic polymerization initiator (E) having a solubility of less than 3 g in 100 g of water, a non-fluorine surfactant (B), a medium (C) and a water-soluble polymer (D) (a polyacrylamide, a polyvinyl alcohol or starch).

10 Claims, No Drawings

WATER REPELLENT AND OIL RESISTANT COMPOSITION

TECHNICAL FIELD

The present invention relates to a water repellent and oil resistant composition, and a substrate such as a paper treated by means of such a composition.

BACKGROUND ART

Reflecting a growing concern about environment, paper has been used for containers for foods, confectionary, etc. To such paper, treatment for water repellency and oil resistance is applied in order to prevent staining of a hand or the like with oil or water contained in the foods, confectionary, etc.

Among methods for treating paper for water repellency and oil resistance, in size press treatment wherein base paper is impregnated or coated with a treating agent, a size press or various coaters are employed, and drying is carried out at a temperature of from 80 to 100° C. for from a few seconds to a few tens minutes. Accordingly, in order to impart a high level of water repellency and oil resistance by drying at such a low temperature for such a short time, a polymer excellent in a film-forming property at a low temperature, i.e. a copolymer of vinylidene chloride and a (meth)acrylate having a polyfluoroalkyl group, has been proposed. However, there has been a problem that since the dipping time is short, absorption to paper tends to be inadequate, and water repellency and oil resistance can not be simultaneously satisfied.

The present inventors have found that by treating paper by means of a water repellent and oil resistant composition comprising a copolymer having certain specific polymerized units and a certain specific water-soluble polymer, high water repellency can be realized while maintaining high oil resistance, even by drying at a low temperature for a short time. The present invention has an object to provide a water repellent and oil resistant composition which is capable of imparting excellent water repellency and oil resistance to paper. Further, the water repellent and oil resistant composition of the present invention is capable of imparting water repellency and oil resistance to a substrate other than paper.

DISCLOSURE OF THE INVENTION

The present invention provides a water repellent and oil resistant composition comprising the following fluorocopolymer (A), a non-fluorine surfactant (B), a medium (C) and the following water-soluble polymer (D), as the essential components:

Water-soluble polymer (D): a water-soluble polymer selected from a polyacrylamide, a polyvinyl alcohol and starch;

Fluorocopolymer (A): a copolymer comprising polymerized units of a (meth)acrylate having a polyfluoroalkyl group, polymerized units of a vinylidene halide and polymerized units of a compound represented by the following formula (1):

$$CH_2{=}C(R)CO{-}Y{-}(CH_2)_n{-}CH(R^4){-}CH_2N^+(R^1)(R^2)(R^3)\cdot X^- \quad (1)$$

provided that symbols in the formula (1) have the following meanings:

R: a hydrogen atom or a methyl group;

Y: an oxygen atom or a bivalent organic group;

$R^1$, $R^2$: each independently is a hydrogen atom or an alkyl group, or they together form an alkylene group, or together form an alkylene group having an etheric oxygen atom between carbon—carbon;

$R^3$: a hydrogen atom or an alkyl group;

$R^4$: a hydroxyl group;

n: 0, 1, 2, 3 or 4; and $X^-$: a counter ion.

BEST MODE FOR CARRYING OUT THE INVENTION

In this specification, a polyfluoroalkyl group is represented by a $R^f$ group. Further, an acrylate and a methacrylate will generally be represented by a (meth)acrylate.

In the present invention, the $R^f$ group is a group having at least two hydrogen atoms of an alkyl group substituted by fluorine atoms. The carbon number of the $R^f$ group is preferably from 2 to 20, particularly preferably from 6 to 16. If the carbon number is less than 2, the water repellency tends to be low, and if it exceeds 20, the polymerizable monomer tends to be solid at normal temperature, and the sublimation property tends to be high, whereby handling tends to be difficult.

The $R^f$ group may have a straight chain structure or a branched structure, but a straight chain structure is preferred. In the case of a branched structure, it is preferred that the branched moiety is present at a terminal portion of the $R^f$ group, and the branched moiety is of a short chain having a carbon number of from about 1 to 4.

Fluorine atoms in the $R^f$ group are preferably at least 60%, particularly preferably at least 80%, when they are represented by [(number of fluorine atoms in the $R^f$ group)/(number of hydrogen atoms contained in an alkyl group having the same carbon number as the $R^f$ group)]×100(%). The $R^f$ group is preferably a group having all hydrogen atoms in an alkyl group substituted by fluorine atoms, i.e. a perfluoroalkyl group (hereinafter referred to as a $R^F$ group). Further, the $R^F$ group is preferably a $R^F$ group having a straight chain structure, i.e. a group represented by $F(CF_2)_i$— (i is an integer of from 2 to 20), particularly preferably a group wherein i is an integer of from 6 to 16.

Further, the $R^f$ group may contain a halogen atom other than a fluorine atom. As such other halogen atom, a chlorine atom is preferred. Further, an etheric oxygen atom or a thioetheric sulfur atom may be inserted between a carbon—carbon bond in the $R^f$ group.

The terminal portion of the $R^f$ group may, for example, be $CF_3CF_2$—, $(CF_3)_2CF$—, $CHF_2$—, $CH_2F$— or $CClF_2$—, and $CF_3CF_2$— is preferred.

Specific examples of the $R^f$ group will be given below. The following examples include structurally isomeric groups having the same molecular formula. In the following examples, t is an integer of from 2 to 20, e is an integer of from 1 to 17, r is an integer of from 1 to 5, z is an integer of from 1 to 6, and w is an integer of from 1 to 9.

$C_4F_9$—[$F(CF_2)_4$—, $(CF_3)_2CFCF_2$—, or $(CF_3)_3C$—], $C_5F_{11}$— [such as $F(CF_2)_5$— or $(CF_3)_3CCF_2$—], $C_6F_{13}$— [such as $F(CF_2)_6$—] $C_7F_{15}$—, $C_8F_{17}$—, $C_9F_{19}$—, $C_{10}F_{21}$—, $Cl(CF_2)_t$—, $H(CF_2)_t$—, $(CF_3)_2CF(CF_2)_e$—, etc.

$F(CF_2)_{50}CF(CF_3)$—, $F[CF(CF_3)CF_2O]_rCF(CF_3)CF_2CF_2$—, $F[CF(CF_3)CF_2O]_zCF(CF_3)$—, $F[CF(CF_3)CF_2O]_zCF_2CF_2$—, $F(CF_2CF_2CF_2O)_zCF_2CF_2$—, $F(CF_2CF_2O)_wCF_2CF_2$—, etc.

$F(CF_2)_5SCF(CF_3)$—, $F[CF(CF_3)CF_2S]_rCF(CF_3)CF_2CF_2$—, $F[CF(CF_3)CF_2S]_zCF(CF_3)$—, $F[CF(CF_3)CF_2S]_z$ $CF_2CF_2$—, $F(CF_2CF_2CF_2S)_zCF_2CF_2$—, $F(CF_2CF_2S)_z$ $CF_2CF_2$—, etc.

In the fluorocopolymer (A), the polymerized units of a (meth)acrylate having a $R^f$ group, are preferably polymerized units of a compound represented by the following formula (2). Here, in the formula (2), $R^f$ is a $R^f$ group, Q is a bivalent organic group, and $R^a$ is a hydrogen atom or a methyl group.

$$R^f—Q—OCOCR^a=CH_2 \quad (2)$$

Q in the formula (2) may preferably be e.g. $—(CH_2)_{p+q}—$, $—(CH_2)_pCONH(CH_2)_q—$, $—(CH_2)_pOCONH(CH_2)_q—$, $—(CH_2)_pSO_2NR^b(CH_2)_q—$, $—(CH_2)_pNHCONH(CH_2)_q—$ or $—(CH_2)_pCH(OH)(CH_2)_q—$. Here, $R^b$ is a hydrogen atom or an alkyl group. Further, each of p and q is an integer of at least 0, and p+q is an integer of from 1 to 22.

Among them, preferred is $—(CH_2)_{p+q}—$, $—(CH_2)_pCONH(CH_2)_q—$ or $—(CH_2)_pSO_2NR^b(CH2)_q—$, wherein q is an integer of at least 2, provided that p+q is from 2 to 6. Particularly preferred is $—(CH_2)_{p+q}—$ wherein p+q is from 2 to 6 i.e. an ethylene group, a trimethylene group, a tetramethylene group, a pentamethylene group or a hexamethylene group is preferred. Further, it is preferred that fluorine atoms are bonded to the carbon atom of $R^f$ bonded to Q.

The (meth)acrylate having a $R^f$ group in the present invention is a compound having a $R^f$ group in an alcohol residue of a (meth)acrylate. The (meth)acrylate having a $R^f$ group may be a single type or two or more types. If the (meth)acrylate having a $R^f$ group is two or more types, it is preferably a mixture of two or more types of compounds differing in the carbon number of the $R^f$ group. Further, the (meth)acrylate having a $R^f$ group is preferably a mixture of two or more types of compounds differing in the carbon number of the $R^f$ group.

The following compounds may preferably be mentioned as the (meth)acrylate having a $R^f$ group in the present invention. Here, $R^a$ is a hydrogen atom or a methyl group, and $R^f$ has the same meaning as the above-mentioned $R^f$ group, and it is particularly preferably a $R^F$ group.

$R^f(CH_2)_2OCOCR^a=CH_2$, $R^fCON(C_3H_7)(CH_2)_2OCOCR=CH_2$, $R^fCH_2CH(CH_3)_2OCOCR^a=CH_2$, $R^fSO_2N(CH_3)(CH_2)_2OCOCR^a=CH_2$, $R^fCON(CH_3)(CH_2)_2OCOCR=CH_2$, $R^fSO_2N(C_2H_5)(CH_2)_2OCOCR^a=CH_2$, $R^fCON(C_2H_5)(CH_2)_2OCOCR^a=CH_2$, $R^fSO_2N(C_3H_7)(CH_2)_2OCOCR^a=CH_2$, $R^fSO_2N(CH_3)(CH_2)_2OCH_2CH(CH_2Cl)OCOCR^a=CH_2$,

The following compounds may preferably be mentioned as specific examples of the (meth)acrylate having a $R^f$ group. Here, $R^a$ is a hydrogen atom or a methyl group.

$F(CF_2)_5CH_2OCOCR^a=CH_2$, $H(CF_2)_6CH_2OCOCR^a=CH_2$, $F(CF_2)_6(CH_2)_2OCOCR^a=CH_2$, $H(CF_2)_8CH_2OCOCR^a=CCH_2$, $H(CF_2)_8(CH_2)_2OCOCR^a=CH_2$, $F(CF_2)_8(CH_2)_8OCOCR^a=CH_2$, $F(CF_2)_8(CH_2)_4OCCCR^a=H_2$, $F(CF_2)_9(CH_2)_2OCOCR^a=CH_2$, $H(CF_2)_{10}CH_2OCOCR^a=CH_2$, $F(CF_2)_{10}(CH_2)_2OCOCR^a=CH_2$, $F(CF_2)_{12}(CH_2)_2OCOCR^a=CH_2$, $(CF_3)_2CF(CF_2)_4(CH_2)_2OCOCR^a=CH_2$, $(CF_3)_2CF(CF_2)_6(CH_2)_2OCOCR^a=CH_2$, $(CF_3)_2CF(CF_2)_8(CH_2)_2OCOCR^a=CH_2$, $F(CF_2)_8SO_2N(CH_3)(CH_2)_2OCOCR^a=CH_2$, $F(CF_2)_8SO_2N(C_2H_7)(CH_2)_2OCOCR^a=CH_2$, $F(CF_2)_8SO_2N(C_3H_7)(CH_2)_2OCOCR^a=CH_2$, $F(CF_2)_9CONH(CH_2)_2OCOCR^a=CH_2$, $F(CF_2)_9CONH(CH_2)_2OCOCR^a=CH_2$, $(CF_3)_2CF(CF_2)_5(CH_2)_3OCOCR^a=CH_2$, $(CF_3)_2CF(CF_2)_5CH_2CH(OCOCH_3)OCOCR^a=CH_2$, $(CF_3)_2CF(CF_2)_5CH_2CH(OH)CH_2OCOCR^a=CH_2$, $(CF_3)_2CF(CF_2)_7CH_2CH(OH)CH_2OCOCR^a=CH_2$.

The polymerized units of a vinylidene halide in the fluorocopolymer (A) are preferably polymerized units of vinylidene chloride or polymerized units of vinylidene fluoride. Particularly preferred are polymerized units of vinylidene chloride, whereby they interact with polymerized units of the compound represented by the formula (1) to improve the film-forming property.

The fluorocopolymer (A) contains also polymerized units of a compound represented by the following formula (1) (which may be referred to also as compound 1, and the same applies hereinafter). Compound 1 is a (meth)acrylate having a cationic moiety.

$$CH_2=C(R)CO—Y—(CH_2)_n—CH(R^4)—CH_2N^+(R^1)(R^2)(R^3)\cdot X^- \quad (1)$$

Here, symbols in the formula (1) have the following meanings.

R: a hydrogen atom or a methyl group,

Y: an oxygen atom or a bivalent connecting group, $R^1$, $R^2$: each independently is a hydrogen atom or an alkyl group, or they together form an alkylene group, or together form an alkylene group having an etheric oxygen atom between carbon—carbon, $R^3$: a hydrogen atom or an alkyl group, $R^4$: a hydrogen atom or a hydroxyl group, n: 0, 1, 2, 3 or 4, and $X^-$: a counter ion.

In compound 1, the specific cationic moiety is preferably one having a quaternary ammonium salt moiety. It is preferred that $R^1$ and $R^2$ each independently represents an alkyl group, or $R^1$ and $R^2$ together form an alkylene group having an etheric oxygen atom between a carbon—carbon bond. $R^3$ is preferably an alkyl group. The alkyl group is preferably a methyl group or an ethyl group.

Further, when $R^1$ and $R^2$ together form an alkylene group or together form an alkylene group having an etheric oxygen atom between a carbon—carbon bond, such an alkylene group is preferably a polymethylene group having a carbon number of at least 2. Specific examples of $R^1$, $R^2$ and $R^3$ will be shown in specific examples given hereinafter.

$R^4$ is a hydrogen atom or a hydroxyl group. n is 0, 1, 2, 3 or 4, preferably 1 or 2. $X^-$ is a counter ion, preferably a chlorine ion, a bromine ion, an iodine ion, a hydrogen sulfate ion ($HSO_4^-$) or an acetic acid ion. Y is preferably an oxygen atom or —NH—.

In the fluorocopolymer (A), compound 1 may be a single type, or two or more types. When it is two or more types, it is preferably composed of two or more types differing in the alkyl group moiety or in the counter ion. By incorporating compound 1, the stability of the composition can be improved. Further, it is thereby possible to impart high water repellency and oil resistance to paper even when drying after treating paper with the composition is at a low temperature or for a short period of time.

Compound 1 is preferably a compound represented by the following formula (1a). Here, symbols in the formula (1a) have the same meanings as in the above formula (1).

$$CH_2{=}C(R)COO{-}CH_2{-}CH(OH){-}CH_2N{+}(CH_3)_3{\cdot}X^- \quad (1a)$$

The following compounds may preferably be mentioned as compound 1. Here, R is a hydrogen atom or a methyl group.

$CH_2{=}C(R)COO(CH_2)_2N^+(CH_3)_3{\cdot}X^-$, $CH_2{=}C\ (R)COO(CH_2)_3N^+(CH_3)_3{\cdot}X^-$, $CH_2{=}C\ (R)COO(CH_2)_2N^+(C_2H)_3{\cdot}X^-$, $CH_2C(R)COO(CH_2)_3N^+(C_2H_5)_3{\cdot}X^-$, $CH_2{=}C\ (R)COOCH_2CH(OH)CH_2N^+(CH_3)_3{\cdot}X^-$, $CH_2{=}C(R)COOCH_2CH(OH)CH_2N^+(C_2H_5)_3{\cdot}X^-$, $CH_2{=}C(R)CONH(CH_2)_2N^+(CH_3)_3{\cdot}X^-$, $CH_2{=}C(R)CONH(CH_2)_3N^+(CH_3)_3{\cdot}X^-$, $CH_2{=}C(R)CONH(CH_2)_2N^+(C_2H_6)_3{\cdot}X^-$, $CH_2{=}C(R)CONH(CH_2)_3N^+(C_2H_5)_3{\cdot}X^-$, $CH_2{=}C(R)COO(CH_2)_2N^+H(CH_3)_2{\cdot}X^-$, $CH_2{=}C(R)COO(CH_2)_3N^+H(CH_3)_2{\cdot}X^-$, $CH_2{=}C(R)COO(CH_2)_2N^+H(C_2H_5)_2{\cdot}X^-$, $CH_2{=}C(R)CONH(CH_2)_2N^+H(CH_3)_2{\cdot}X^-$, $CH_2{=}C(R)CONH(CH_2)_3N^+H(C_2H_5)_2{\cdot}X^-$, $CH_2{=}C(R)CONH(CH_2)_2N^+H(C_2H_5)_2{\cdot}X^-$, $CH_2{=}C(R)CONH(CH_2)_3N^+H(C_2H_5)_2{\cdot}X^-$.

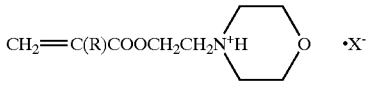

The fluorocopolymer (A) may contain polymerized units of other polymerizable monomers than the above-mentioned polymerizable monomers. The following compounds may preferably be mentioned as such other polymerizable monomers.

Ethylene, vinyl acetate, vinyl chloride, vinyl fluoride, a vinyl halide, styrene, α-methyl styrene, p-methyl styrene, an alkyl (meth)acrylate, (meth)acrylic acid, a polyoxyalkylene (meth)acrylate, (meth)acrylamide, diacetone (meth) acrylamide, methylol-modified (meth)acrylamide (such as N-methylol (meth)acrylamide), an alkyl vinyl ether, a halogenated alkyl vinyl ether, an alkyl vinyl ketone, butadiene, isoprene, chloroprene, glycidyl (meth)acrylate, 2-hydroxyethyl (meth)acrylate, aziridinyl (meth)acrylate, benzyl (meth)acrylate, isocyanate ethyl (meth)acrylate, cyclohexyl (meth)acrylate, 2-ethylhexyl (meth)acrylate, maleic anhydride, a (meth)acrylate having polysiloxane, N-vinyl carbazole, etc. These compounds may be used alone or in combination of two or more of them.

As such other polymerizable monomer, an alkyl (meth) acrylate having an alkyl group with a carbon number of at least 12, is preferred from the viewpoint of the texture of the coating film, the film-forming property, etc. As such an alkyl (meth)acrylate, lauryl (meth)acrylate, cetyl (meth)acrylate, stearyl (meth)acrylate or behenyl (meth)acrylate is preferred.

The polymerized units of a (meth)acrylate having a $R^f$ group in the fluorocopolymer (A) are preferably from 30 to 80 mass %, particularly preferably from 45 to 60 mass %. The polymerized units of a vinylidene halide are preferably from 15 to 60 mass %, particularly preferably from 35 to 50 mass %. The polymerized units of compound 1 are preferably from 0.5 to 10 mass %, particularly preferably from 0.5 to 5 mass %.

The non-fluorine surfactant (B) in the present invention is a surfactant having no fluorine atom in its molecule. The non-fluorine surfactant (B) is preferably at least one member selected from the following surfactant ($b^1$), the following surfactant ($b^2$), the following surfactant ($b^3$) and the following surfactant ($b^4$). The non-fluorine surfactant (B) is preferably a non-ionic surfactant and/or a cationic surfactant, and it may contain a non-fluorine surfactant other than the surfactants ($b^1$) to ($b^4$) (hereinafter referred to as other surfactant) for the purpose of improving various properties of the composition.

Surfactant ($b^1$): at least one nonionic surfactant selected from a polyoxyalkylene monoalkyl ether, a polyoxyalkylene monoalkenyl ether and a polyoxyalkylene mono(substituted aryl) ether;

Surfactant ($b^2$): a nonionic surfactant composed of a compound having at least one triple bond and at least one hydroxyl group in its molecule;

Surfactant ($b^3$): a nonionic surfactant composed of a compound wherein polyoxyethylene moieties and moieties each having at least two oxyalkylene groups with at least three carbon atoms chained, are chained, and both terminals are hydroxyl groups; and Surfactant ($b^4$): a cationic surfactant represented by the following formula (3):

$$[(R^{10})(R^{11})(R^{12})(R^{13})N^+]{\cdot}[X^{10}] \quad (3)$$

provided that symbols in the formula (3) have the following meanings:

$R^{10}$, $R^{11}$, $R^{12}$, $R^{13}$: each independently is a hydrogen atom, a $C_{1-22}$ alkyl group, a $C_{2-22}$ alkenyl group or a polyoxyalkylene group having a terminal hydroxyl group, prodided that $R^{10}$, $R^{11}$, $R^{12}$ and $R^{13}$ are not simultaneously hydrogen atoms; and $[X^{10}]^-$: a counter ion.

The surfactant ($b^1$) is a non-ionic surfactant made of a polyoxyalkylene monoalkyl ether, a polyoxyalkylene monoalkenyl ether or a polyoxyalkylene mono(substituted aryl) ether.

In the surfactant ($b^1$), the alkyl group is preferably a $C_{4-26}$ alkyl group, and the alkenyl group is preferably a $C_{4-26}$ alkenyl group. The alkyl group or the alkenyl group may have a linear structure or a branched structure. In the case of a branched structure, it may be a secondary group. As a specific example of the alkyl group or the alkenyl group, an octyl group, a dodecyl group, a tetradecyl group, a hexadecyl group, an octadecyl group, a dococyl group or an oleyl group (a 9-octadecenyl group) may, for example, be mentioned.

As the substituted aryl group in the polyoxyalkylene mono(substituted aryl) ether, a substituted phenyl group is preferred. Namely, a phenyl group substituted by an alkyl group, an alkenyl group, a hydroxy phenyl group, a methyl group, a hydroxyl group or a styryl group, is preferred. Especially preferred is a phenyl group substituted by an alkyl having a carbon number of at least 6, or a phenyl group substituted by an alkenyl group having a carbon number of at least 6.

The polyoxyalkylene moiety in the surfactant ($b^1$) is preferably at least one type of an oxyalkylene group, and when it is composed of two or more types, their chain is preferably a block form. The polyoxyalkylene moiety is a moiety wherein at least two oxyethylene and/or oxypropylene are chained.

When the surfactant ($b^1$) is a polyoxyalkylene monoalkyl ether or a polyoxyalkylene monoalkenyl ether, it is preferably a compound represented by the following formula (4). In the following formula (4), $R^{20}$ is an alkyl group having a carbon number of at least 8 or an alkenyl group having a carbon number of at least 8, s is an integer of from 5 to 50, and g is an integer of from 0 to 20. Further, the chain of the oxypropylene moiety and the oxyethylene moiety in compound 4 is a block form.

$$R^{20}O—[CH_2CH(CH_3)O]_g—(CH_2CH_2O)_sH \quad (4)$$

$R^{20}$ in compound 4 may have a straight chain structure or a branched structure. Further, s is preferably an integer of from 5 to 30, particularly preferably an integer of from 10 to 30. g is preferably an integer of from 0 to 10. If s is 4 or less or if g is 21 or higher, it tends to be hardly soluble in water and can not uniformly be dissolved in an aqueous medium, whereby the effect for improvement of the penetrability into paper tends to be low. Further, if s is 51 or higher, the hydrophilic nature tends to be high, whereby water repellency tends to deteriorate.

Specific examples of compound 4 will be given below. However, in the following formula, s or g has the same meaning as described above, s is preferably an integer of from 10 to 30, and g is preferably an integer of from 0 to 10. Further, the alkyl group or the alkenyl group may respectively has a straight chain structure or a branched structure, and the chain of the oxypropylene group and the oxyethylene group is a block form.

$$C_{18}H_{37}O—[CH_2CH(CH_3)O]_g—(CH_2CH_2O)_4H,$$

$$C_{18}H_{35}O—[CH_2CH(CH_3)O]_g—(CH_2CH_2O)_sH,$$

$$C_{16}H_{33}O—[CH_2CH(CH_3)O]_g—(CH_2CH_2O)_sH,$$

$$C_{12}H_{25}O\Delta[CH_2CH(CH_3)O]_g—(CH_2CH_2O)_sH,$$

$$(C_8H_{17})(C_6H_{13})CH—[CH_2CH(CH_3)O]_g—(CH_2CH_2O)_sH,$$

$$C_{10}H_{21}O—[CH_2CH(CH_3)O]_g—(CH_2CH_2O)_sH.$$

As a specific example of a case where the surfactant ($b^1$) is a polyoxyalkylene mono(substituted aryl) ether, polyoxyethylene mono(nonylphenyl) ether, polyoxyethylene mono (octylphenyl) ether or polyoxyethylene mono(oleylphenyl) ether may be mentioned.

The surfactant ($b^2$) is a nonionic surfactant composed of a compound having at least one triple bond and at least one hydroxyl group in its molecule.

As the surfactant ($b^2$), a surfactant having one triple bond and one or two hydroxyl groups in its molecule, is preferred. Further, such a surfactant may further have at least oxyalkylene moiety or a polyoxyalkylene moiety. The polyoxyalkylene moiety may be polyoxyethylene, polyoxypropylene, a moiety in which oxyethylene and oxypropylene are randomly chained, or a moiety in which polyoxyethylene and polyoxypropylene are chained in a block form.

As a specific example of the surfactant ($b^2$), a compound represented by the following formula (5), (6), (7) or (8), is preferred.

$$HO—CR^{30}R^{31}—C\equiv C—CR^{32}R^{33}—OH \quad (5)$$

$$HO—(A^1O)_m—CR^{30}R^{31}—C—C\equiv CR^{32}R^{33}—(OA^2)—OH \quad (6)$$

$$HO—CR^{34}R^{35}—C\equiv C—H \quad (7)$$

$$HO—(A^3O)_k—CR^{34}R^{35}—C\equiv C—H \quad (8)$$

Here, each of $R^{30}$, $R^{31}$, $R^{32}$, $R^{33}$, $R^{34}$ and $R^{35}$ is a hydrogen atom or an alkyl group. The alkyl group is preferably a $C_{1-12}$ alkyl group having a straight chain structure or a branched structure. For example, a methyl group, an ethyl group, a propyl group, a butyl group or an isobutyl group is preferably mentioned.

Each of $A^1$, $A^2$ and $A^3$ which are independent of one another, is an alkylene group, and m or j is respectively an integer of at least 0, and (m+j) is an integer of at least 1. k is an integer of at least 1. When m, j and k are respectively 2 or more, $A^1$, $A^2$ or $A^3$ may be one or more alkylene groups.

As the surfactant ($b^2$), compound 5 or compound 6 are preferred, and further, a compound represented by the following formula (9) is also preferred. In compound 9, x or y is respectively an integer of at least 0. Compound 9 may be a single type, or two or more types.

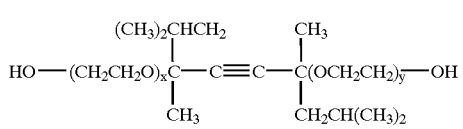

(9)

As compound 9, a compound wherein the average of the sum of x and y is 10, a compound wherein x is 0 and y is 0, or a compound wherein the average of the sum of x and y is 1.3, is preferred.

The surfactant ($b^3$) is a nonionic surfactant composed of a compound wherein polyoxyethylene moieties and moieties each having at least two oxyalkylene groups with at least three carbon atoms chained, are chained, and both terminals are hydroxyl groups. The moieties each having at least two oxyalkylene groups with at least three carbon atoms chained, are preferably polyoxytetramethylene and/or polyoxypropylene.

As the surfactant ($b^3$), a compound represented by the following formula (10) or (11) is preferred. In the following formula, h is an integer of from 2 to 200, u is an integer of from 2 to 100, and v is an integer of from 2 to 20. Further, in the following formula, the polyoxyethylene moieties, the polyoxypropylene moieties or the polyoxytetramethylene moieties, are meant to be chained in block forms. Further, the structure of the —$(C_3H_6O)$— moiety may be —$[CH_2CH(CH_3)O]$—, —$[CH(CH_3)CH_2O]$—, or a structure wherein both are present, and the structure wherein both are present, is preferred.

$$HO—(CH_2CH_2O)_h—(C_3H_6O)_u—(CH_2CH_2O)_vH \quad (10)$$

$$HO—(CH_2CH_2O)_h—(CH_2CH_2CH_2CH_2O)_u—(CH_2CH_2O)_vH \quad (11)$$

As the surfactant ($b^3$), the following compounds are preferred.

$$HO—(CH_2CH_2O)_{15}—(C_3H_6O)_{35}—(CH_2CH_2O)_{15}H,$$

$$HO—(CH_2CH_2O)_8—(C_3H_6O)_{35}—(CH_2CH_2O)_8H,$$

$$HO—(CH_2CH_2O)_{45}—(C_3H_6O)_{17}—(CH_2CH_2O)_{45}H,$$

$$HO—(CH_2CH_2O)_{34}—(CH_2CH_2CH_2CH_2O)_{28}—(CH_2CH_2O)_{34}H.$$

The surfactant ($b^4$) is a cationic surfactant made of a compound represented by the above formula (3).

When each of $R^{10}$ to $R^{13}$ in compound 3 is an alkyl group, at least one of them is preferably a long chain alkyl group having a carbon number of from 6 to 22. Further, in a case where it is an alkyl group having a carbon number of at most 5, a methyl group or an ethyl group is preferred. When each of $R^{10}$ to $R^{13}$ is an alkenyl group, a $C_{6-22}$ alkenyl group is preferred. When each of $R^{10}$ to $R^{13}$ is a polyoxyalkylene group having a terminal hydroxyl group, a polyoxyethylene group having a terminal hydroxy group, is preferred. At least one of $R^{10}$ to $R^{13}$ is preferably a long chain alkyl group having a carbon number of from 6 to 22.

As $[X^{10}]^-$, a chlorine ion, an ethyl sulfate ion, a sulfate ion or an acetate ion, is preferred.

As a specific example of compound 3, a mono(long chain alkyl)amine hydrochloride, a mono(long chain alkyl) dimethylamine hydrochloride, a mono(long chain alkyl) dimethylamine acetate, a mono(long chain alkenyl) dimethylamine hydrochloride, a mono(long chain alkyl) dimethylamine-ethyl sulfate, a mono(long chain alkyl) trimethylammonium chloride, a di(long chain alkyl) monomethylamine hydrochloride, a di(long chain alkyl) dimethylammonium chloride, a mono(long chain alkyl) monomethyldi(polyoxyethylene)ammonium chloride, or di(long chain alkyl)monomethylmono(polyoxyethylene) ammonium chloride may be mentioned.

As compound 3, monooctadecyltrimethylammonium chloride (hereinafter referred to as B3), monooctadecyldimethylmonoethylammonium ethylsulfate, a mono(long chain alkyl)monomethyldi(polyethyleneglycol)ammonium chloride, a di(beef tallow alkyl)dimethylammonium chloride or dimethylmonococonutsamine acetate is, for example, preferred.

As other surfactants, it is preferred to use nonionic surfactants other than the surfactants ($b^1$) to ($b^3$) (hereinafter referred to as other nonionic surfactants) or amphoteric surfactants. As other nonionic surfactants, a condensate of a polyoxyethylenemono(alkylfinyl)ether, a fatty acid ester of a polyol, a polyoxyethylene fatty acid amide, or a nonionic surfactant having an amine oxide moiety in its molecule, is preferred.

Among nonionic surfactants, as the condensate of a polyoxyethylenemono(alkylphenyl)ether, the above-mentioned formaldehyde condensate of a polyoxyethylenemono(alkylphenyl)ether is, for example, preferred.

As the fatty acid ester of a polyol, the following compounds are preferred.

A 1:1 (molar ratio) ester of octadecanoic acid and polyethylene glycol, a 1:4 (molar ratio) ester of an ether of sorbit with a polyethylene glycol, and oleic acid, a 1:1 (molar ratio) ester of an ether of polyethylene glycol with sorbitan, and octadecanoic acid, a 1:1 (molar ratio) ester of an ether of polyethylene glycol with sorbitan, and oleic acid, a 1:1 (molar ratio) ester of dodecanoic acid and sorbitan, a (1 or 2):1 (molar ratio) ester of oleic acid and decaglycerine, a (1 or 2):1 (molar ratio) ester of octadecanoic acid and decaglycerine.

The polyoxyethylene fatty acid amide is a nonionic surfactant made of an oxyethylene adduct of a fatty acid amide, or a dehydrated condensate of a fatty acid amide with polyethylene glycol, and it is preferably a nonionic surfactant made of a compound obtained by adding oxyethylene to a hydrogen atom of $—NH_2$ of a fatty acid amide, or by dehydration condensation of a polyalkylene glycol. The polyoxyethylene fatty acid amide is preferably an oxyethylene adduct of dodecanoic amide, an oxyethylene adduct of oleic amide, or an oxyethylene adduct of octadecanoic amide.

As the nonionic surfactant having an amine oxide moiety in the molecule, a compound represented by the following formula (12) is preferred. Here, each of $R^{41}$, $R^{42}$ and $R^{43}$ which are independent of one another, is a monovalent hydrocarbon group. Further, a surfactant having an amine oxide moiety (N→O) in the molecule may sometimes be classified in a cationic surfactant, but in this specification, it will be regarded as a nonionic surfactant.

As the nonionic surfactant having an amine oxide moiety in the molecule, a nonionic surfactant represented by the following formula (13) is particularly preferred, since it improves the dispersion stability of the fluorocopolymer (A).

Here, in compound 13, it is preferred that $R^{44}$ is a $C_{6-22}$ alkyl group, a $C_{6-22}$ alkenyl group, a phenyl group to which a $C_{6-22}$ alkyl group is bonded, a phenyl group to which a $C_{6-22}$ alkenyl group is bonded, a $C_{8-22}$ alkyl group, or a $C_{8-22}$ alkenyl group.

$$(R^{41})(R^{42})(R^{43})N(\rightarrow O) \quad (12)$$

$$(R^{44})(CH_3)_2N(\rightarrow O) \quad (13)$$

As the nonionic surfactant having an amine oxide moiety in the molecule, the following compound may be mentioned.

$$[H(CH_2)_{12}](CH_3)_2N(\rightarrow O),$$

$$[H(CH_2)_{14}](CH_3)_2N(\rightarrow O),$$

$$[H(CH_2)_{16}](CH_3)_2N(\rightarrow O),$$

$$[H(CH_2)_{18}]\ (CH_3)_2N(\rightarrow O).$$

As the amphoteric surfactant, dodecylbetaine, octadecylbetaine, dodecyl(dimethylamino acetic acid) betaine, fatty acid amide propyl dimethylamino acetic acid betaine, or dodecyl(carboxymethyl)(hydroxyethyl) imidazolinium betaine, may, for example, be mentioned.

The non-fluorine surfactant (B) may be used alone as a single type or in combination of two or more types. When surfactants having different ionic characteristics are used in combination, a combination of a nonionic surfactant and a cationic surfactant, or a combination of a nonionic surfactant and an amphoteric surfactant, is preferred. Here, the amount of the non-fluorine surfactant (B) is preferably from 0.1 to 10 mass %, relative to the fluorocopolymer (A). However, in a case where the fluorocopolymer (A) contains self-emulsifiable polymerized units, the amount of the non-fluorine surfactant (B) may be reduced.

For the non-fluorine surfactant (B), a method of adding it at the time of the polymerization reaction and/or a method of adding it after the polymerization reaction, may be employed. Namely, the non-fluorine surfactant (B) may be present at the time of the polymerization reaction, or may be post-added at the time of preparing the composition.

As the medium (C), water alone, or a medium comprising water and a water-soluble organic solvent, is preferred. As the water-soluble organic solvent, an organic solvent of ester type, ketone type, ether type or the like, is preferred. The ratio of water and the water-soluble organic solvent is not particularly limited. The amount of the water-soluble organic solvent is preferably from 0.1 to 60 mass %, particularly preferably from 30 to 50 mass %, relative to the fluorocopolymer (A).

As the water-soluble organic solvent, acetone, ethylene glycol monoethyl ether monoacetate, ethylene glycol monoethyl ether, ethylene glycol monomethyl ether, ethylene glycol mono-n-butyl ether, ethylene glycol mono-t-butyl ether, propylene glycol monomethyl ether, propylene glycol monomethyl ether monoacetate, dipropylene glycol monomethyl ether (hereinafter referred to as DPGMME), tripropylene glycol monomethyl ether, propylene glycol dibutyl ether, ethyl 3-ethoxypropionate, 3-methoxy-3-methyl-1-butanol, isopropyl alcohol, n-butyl alcohol, isobutyl alcohol, ethanol, ethylene glycol, propylene glycol, dipropylene glycol or tripropylene glycol may, for example, be mentioned, and particularly preferred is DPGMME.

As the water-soluble polymer (D), polyacrylamide or polyvinyl alcohol is particularly preferred.

As the polyacrylamide, nonionic polyacrylamide or cationic polyacrylamide is preferred. It is particularly preferred to use at least one member of nonionic polyacrylamides and cationic polyacrylamides, respectively. A nonionic polyacrylamide is preferred, since it does not change the ionic characteristics of the composition. A cationic polyacrylamide is preferred, since the fixing property of the composition to paper (anionic) will be thereby improved. The molecular weight of the polyacrylamide is preferably from 10,000 to 10,000,000, more preferably from 100,000 to 5,000,000, particularly preferably from 200,000 to 1,500,000.

The molecular weight of the polyvinyl alcohol is preferably from 300 to 10,000, more preferably from 1,000 to 5,000. Further, the sapponification degree of the polyvinyl alcohol is preferably from 70 to 100 mol %, particularly preferably from 95 to 100 mol %. As the starch, processed starch such as oxidized starch, enzymatically decomposed starch, dialdehyde starch, hydroxyethyl starch, starch phosphate, starch acetate or a starch, is preferred.

The water-soluble polymer (D) may be added at the time of preparing the composition or may be added before the polymerization reaction. However, it is preferred to add it at the time of preparing the composition. It is particularly preferred to add it to the composition after dilution with water. The amount of the water-soluble polymer (D) is preferably from 0.2 to 3.0 mass %, particularly preferably from 0.5 to 1.2 mass %, in the composition.

The method for polymerizing the fluorocopolymer (A) is not particularly limited. For example, it is preferred to polymerize it by an emulsion polymerization method or a dispersion polymerization method. The polymerization reaction is preferably carried out in a medium, and it is preferred to carry out it by means of a non-fluorine surfactant (B) and/or a lipophilic polymerization initiator (E) having a solubility of less than 3 g in 100 g of water. The polymerization temperature is not particularly limited, but is preferably from 20 to 150° C., particularly preferably from 50 to 70° C.

As the lipophilic polymerization initiator (E) having a solubility of less than 3 g in 100 g of water, a common polymerization initiator of azo type, peroxide type, redox type or the like, may be used depending upon the polymerization temperature. As such a lipophilic polymerization initiator (E), an azo type compound is particularly preferred. The amount of such a lipophilic polymerization initiator (E) is preferably from 0.1 to 2.0 mass %, particularly preferably from 0.2 to 0.5 mass %, relative to the fluorocopolymer (A). By using such a lipophilic polymerization initiator (E), the average particle size of the fluorocopolymer (A) can be made small, and when paper is treated by means of a composition containing such a fluorocopolymer (A), treatment can be carried out uniformly and in a high density, whereby water repellency and oil resistance of paper can be improved.

In the polymerization reaction, a chain transfer agent may be employed for the purpose of controlling the molecular weight. As the chain transfer agent, an aromatic compound or a mercaptan is preferred, and particularly preferred is an alkyl mercaptan. Specifically, n-octyl mercaptan, n-dodecyl mercaptan, t-dodecyl mercaptan, stearyl mercaptan or a-methylstyrene dimer [$CH_2{=}CPhCH_2C(CH_3)_2Ph$ (wherein Ph is a phenyl group)] may preferably be mentioned.

It is preferred that prior to the polymerization reaction, a mixture comprising the polymerizable monomer, the surfactant and the medium, are preliminarily dispersed by a homomixer or a high pressure emulsifier. By thoroughly stirring the mixture before initiation of the polymerization, the yield of the finally obtainable polymer can be improved.

The composition of the present invention may be prepared by dispersing the fluorocopolymer (A) in the medium (C). However, usually, in the polymerization reaction, by using the medium (C) as the polymerization medium, the composition can be prepared directly. Further, depending upon the treating method, it is preferred to prepare the composition diluted with water.

When paper is treated by means of the composition of the present invention, it is preferred to employ a method wherein paper is treated by a method such as dipping or coating, followed by drying to remove the medium (C). The treating method for paper may be size press treatment or internal sizing treatment. However, size press treatment is preferred, since the treatment is easy. Further, the drying conditions after treating paper by means of the composition of the present invention, are not particularly limited, since adequate performance can be obtained even under drying conditions of a low temperature and a short period of time. The drying temperature is preferably from 60 to 130° C., and the drying time is preferably from 1 second to 1 minute, particularly preferably from 1 to 30 seconds. The deposited amount of the fluorocopolymer (A) on paper is preferably from 0.1 to 3.0 mass %, based on the mass of the paper. The obtained treated paper can be used as it is or after processed into other shapes, as a container for foods, etc.

The water repellent and oil resistant composition of the present invention is capable of imparting excellent water repellency and oil resistance to paper even under drying conditions of a low temperature and a short period of time. Further, the water repellent and oil resistant composition of the present invention is capable of imparting water repellency and oil resistance to a substrate other than paper. As the substrate other than paper, a porous sheet such as a non woven fabric or woven fabric may be mentioned. Further, as the material for the substrate, not only cellulose but also a synthetic polymer or a natural polymer may be mentioned. The substrate treated with the composition of the present invention can be used not only as a container for foods but also as a sheet for packaging articles other than foods.

EXAMPLES

The present invention will be described with reference to Preparation Examples of polymers (Examples 1 to 6), Working Examples (Examples 7 to 12) and Comparative Examples (Examples 13 to 20). In the following, oil resistance was measured by TAPPI RC-388 Kit test and represented by the oil resistance shown in Table 1. The water repellency was measured by JIS P-8137 and represented by the water repellency shown in Table 2. The results with respect to Examples 1 to 6, are shown in Table 3, and the results with respect to Example 7 to 20, are shown in Table 4.

TABLE 1

| Oil resistance | Castor oil | Toluene | n-Heptane |
|---|---|---|---|
| 1 | 100 vol % | 0 vol % | 0 vol % |
| 2 | 90 | 5 | 5 |
| 3 | 80 | 10 | 10 |
| 4 | 70 | 15 | 15 |
| 5 | 60 | 20 | 20 |
| 6 | 50 | 25 | 25 |
| 7 | 40 | 30 | 30 |
| 8 | 30 | 35 | 35 |
| 9 | 20 | 40 | 40 |
| 10 | 10 | 45 | 45 |
| 11 | 0 | 50 | 50 |
| 12 | 0 | 45 | 55 |
| 13 | 0 | 35 | 65 |
| 14 | 0 | 25 | 75 |
| 15 | 0 | 15 | 85 |
| 16 | 0 | 0 | 100 |

TABLE 2

| Water repellency | Results |
|---|---|
| $R_0$ | A continuous trail with a uniform width. |
| $R_2$ | A continuous trail with a width slightly narrower than a water droplet. |
| $R_4$ | A continuous trail, but intermittently broken, with a width distinctly narrower than a water droplet. |
| $R_6$ | A trail, of which a half is wet. |
| $R_7$ | A trail, of which ¼ is wet with an elongated water droplet. |
| $R_8$ | A trail, of which at least ¼ is dotted with spherical water droplets. |
| $R_9$ | Spherical small droplets are scattered. |
| $R_{10}$ | Completely rolled off. |

Example 1

Into a 1 l reactor equipped with a stirrer, 159.4 g (60.0 parts) of a perfluoroalkylethyl acrylate [$C_mF_{2m+1}CH_2CH_2OCOCH{=}CH_2$ (a mixture of those wherein m is 6, 8, 10, 12, 14 and 16, the average of m being 9, hereinafter referred to as FA)], 103.6 g (39.0 parts) of vinylidene chloride (hereinafter referred to as VdCL), 2.7 g (1.0 part) of N,N,N-trimethyl-N-(2-hydroxy-3-methacryloyloxypropyl) ammonium chloride ([$CH_2{=}C(CH_3)CO{-}O{-}CH_2CH(OH)CH_2N^+(CH_3)_3{\cdot}Cl^-$], hereinafter referred to as HPTMA), 13.3 g of a polyoxyethylene polycyclic phenyl ether (tradename "Newcoal 723", manufactured by Nippon Nyukazai Co., Ltd.) and 2.7 g of B3 (tradename "Arcard 18-63", manufactured by Lion Akzo Co., Ltd.), as surfactants, 398.4 g of deionized water, 119.5 g of DPGMME, and 0.5 g of azobisimidazoline propane as a lipophilic polymerization initiator (tradename "VA-061", manufactured by Wako Kasei K.K., solubility being at least 0.3 g and less than 3 g), were added.

This reactor was substituted with nitrogen and then heated to 60° C. with stirring at 300 rpm, followed by polymerization for 15 hours. After cooling, a brown emulsion was obtained in a yield of 96%. The conversion of the polymerization reaction was calculated from the measurement by gas chromatography and found to be 99.6% (based on FA). Further, the average particle size of the copolymer was 0.065 μm, as a result of the measurement by a light scattering method.

Examples 2 and 3

Brown emulsions were obtained in the same manner as in Example 1 except that the amounts of FA, VdCL and HPTMA were changed as shown in Table 3.

Examples 4 to 6

Brown emulsions were obtained in the same manner as in Example 1 except that the amounts of FA, VdCL and HPTMA were changed as shown in Table 3, and instead of the lipophilic polymerization initiator, azobis amidinopropane hydrochloride as a hydrophilic polymerization initiator (tradename "V-50", manufactured by Wako Kasei K.K., the solubility being at least 3 g) was used.

TABLE 3

| Example | Composition for compolymerization (mass %) FA/VdCL/HPTMA | Polymerization initiator | Yield (%) | Average particle size (μm) |
|---|---|---|---|---|
| 1 | 60/39/1 | Lipophilic | 96 | 0.065 |
| 2 | 55/44/1 | Lipophilic | 95 | 0.063 |
| 3 | 50/48/2 | Lipophilic | 94 | 0.070 |
| 4 | 60/39/1 | Hydrophilic | 88 | 0.090 |
| 5 | 55/44/1 | Hydrophilic | 86 | 0.093 |
| 6 | 50/48/2 | Hydrophilic | 84 | 0.091 |

Example 7

The emulsion of Example 1 was diluted with deionized water so that the solid content concentration would be 0.9 mass %, and further polyacrylamide (tradename "Haricoat 1057", manufactured by Harima Chemicals, Inc., molecular weight: about 400,000, hereinafter referred to as PAA) was added so that it would be 0.2 mass %, to prepare a treating bath. In this treating bath, non-sized paper (weight: 85 g/m$^2$) was dipped, and the pickup was adjusted to 60% by means of a size press. Then, it was dried for 30 seconds in a drum drier heated to 100° C. to obtain treated paper. With respect to the obtained treated paper, the above-described measurements were carried out.

Examples 8 to 20

Using the polymer as disclosed in Table 4, a treating bath was prepared to have the emulsion solid content concentration, the PAA concentration or a polyvinyl alcohol (tradename "Poval PVA-117", manufactured by Kuraray Co., Ltd., molecular weight: 1,700, hereinafter referred to as PVA) concentration, as disclosed in Table 4.

Using this treating bath, treated paper was obtained in the same manner as in Example 7. With respect to the obtained treated paper, the above-described measurements were carried out.

TABLE 4

| Example | Polymer | Emulsion solid content concentration (mass %) | PAA concentration (mass %) | PVA concentration (mass %) | Oil resistance | Water repellency |
|---|---|---|---|---|---|---|
| 7 | Ex. 1 | 0.9 | 0.2 | | 16 | $R_6$ |
| 8 | Ex. 1 | 0.9 | 0.8 | | 16 | $R_9$ |
| 9 | Ex. 1 | 1.2 | 0.2 | | 16 | $R_4$ |
| 10 | Ex. 1 | 1.2 | 0.8 | | 16 | $R_9$ |
| 11 | Ex. 1 | 0.9 | | 1.0 | 16 | $R_4$ |
| 12 | Ex. 1 | 1.2 | | 1.0 | 16 | $R_6$ |
| 13 | Ex. 1 | 0.9 | | | 16 | $R_2$ |
| 14 | Ex. 1 | 1.2 | | | 16 | $R_2$ |
| 15 | Ex. 4 | 0.9 | 0.8 | | 14 | $R_2$ |
| 16 | Ex. 4 | 1.2 | 0.8 | | 15 | $R_2$ |
| 17 | Ex. 4 | 0.9 | | 1.0 | 14 | $R_2$ |
| 18 | Ex. 4 | 1.2 | | 1.0 | 14 | $R_2$ |
| 19 | Ex. 4 | 0.9 | | | 14 | $R_2$ |
| 20 | Ex. 4 | 1.2 | | | 14 | $R_2$ |

The entire disclosure of Japanese Patent Application No. 2000-309748 filed on Oct. 10, 2000 including specification, claims and summary are incorporated herein by reference in its entirety.

What is claimed is:

1. A water repellent and oil resistant composition comprising the following fluorocopolymer (A), a non-fluorine surfactant (B), a medium (C) and the following water-soluble polymer (D), as the essential components:

Water-soluble polymer (D): a water-soluble polymer selected from a polyacrylamide, a polyvinyl alcohol and starch;

Fluorocoplymer (A): a copolymer comprising polymerized units of a (meth)acrylate having a polyfluoroalkyl group, polymerized units of a vinylidene halide and polymerized units of a compound represented by the following formula (1):

$$CH_2{=}C(R)CO{-}Y{-}(CH_2)_n{-}CH(R^4){-}CH_2N^+(R^1)(R^2)(R^3)\cdot X^- \quad (1)$$

provided that symbols in the formula (1) have the following meanings:

R: a hydrogen atom or a methyl group;

Y: an oxygen atom or a bivalent organic group;

$R^1$, $R^2$: each independently is a hydrogen atom or an alkyl group, or they together form an alkylene group, or together form an alkylene group having an etheric oxygen atom between carbon—carbon;

$R^3$: a hydrogen atom or an alkyl group;

$R^4$: a hydrogen atom or a hydroxyl group;

n: 0, 1, 2, 3 or 4; and $X^-$: a counter ion.

2. The water repellent and oil resistant composition according to claim 1, wherein the fluorocopolymer (A) is a copolymer polymerized by means of a lipophilic polymerization initiator (E) having a solubility of less than 3 g in 100 g of water.

3. The water repellent and oil resistant composition according to claim 1, wherein the compound represented by the formula (1) is a compound represented by the formula (1a):

$$CH_2{=}C(R)COO{-}CH_2{-}CH(OH){-}CH_2N^+(CH_3)_3\cdot X^- \quad (1a)$$

provided that R or $X^-$ in the formula (la) has the same meaning as in the formula (1).

4. The water repellent and oil resistant composition according to claim 1, wherein in the fluorocopolymer (A), the polymerized units of a (meth)acrylate having a polyfluoroalkyl group are from 30 to 80 mass %, the polymerized units of a vinylidene halide are from 15 to 60 mass %, and the polymerized units of a compound represented by the formula (1) are from 0.5 to 10 mass %.

5. The water repellent and oil resistant composition according to claim 1, wherein the non-fluorine surfactant (B) is at least one member selected from the following surfactant ($b^1$), the following surfactant ($b^2$), the following surfactant ($b^3$) and the following surfactant ($b^4$):

Surfactant ($b^1$):at least one nonionic surfactant selected from a polyoxyalkylene monoalkyl ether, a polyoxyalkylene monoalkenyl ether and a polyoxyalkylene mono(substituted aryl) ether;

Surfactant ($b^2$): a nonionic surfactant composed of a compound having at least one triple bond and at least one hydroxyl group in its molecule;

Surfactant ($b^3$): a nonionic surfactant composed of a compound wherein polyoxyethylene moieties and moieties each having at least two oxyalkylene groups with at least three carbon atoms chained, are chained, and both terminals are hydroxyl groups; and Surfactant ($b^4$): a cationic surfactant represented by the following formula (3):

$$[(R^{10})(R^{11})(R^{12})(R^{13})N^+]\cdot[X^{10}] \quad (3)$$

provided that symbols in the formula (3) have the following meanings:

$R^{10}$, $R^{11}$, $R^{12}$, $R^{13}$: each independently is a hydrogen atom, a $C_{1-22}$ alkyl group, a $C_{2-22}$ alkenyl group or a polyoxyalkylene group having a terminal hydroxyl group, prodided that $R^{10}$, $R^{11}$, $R^{12}$ and $R^{13}$ are not simultaneously hydrogen atoms; and $[X^{10}]^-$: a counter ion.

6. The water repellent and oil resistant composition according to claim 1, wherein the medium (C) is a medium composed solely of water or a medium composed of water and a water-soluble organic solvent.

7. A substrate treated by means of the water repellent and oil resistant composition as defined in claim 1.

8. A paper treated by means of the water repellent and oil resistant composition as defined in claim 1.

9. A method for treating a substrate, characterized by treating the substrate with the water repellent and oil resistant composition as defined in claim 1, followed by drying to remove the solvent (C) and to have the fluorocopolymer (A) attached to the substrate.

10. The treating method according to claim 9, wherein the substrate is a paper.

* * * * *